US006582870B2

(12) United States Patent
Kayamoto et al.

(10) Patent No.: US 6,582,870 B2
(45) Date of Patent: Jun. 24, 2003

(54) CARRIER FOR ELECTROPHOTOGRAPHIC DEVELOPER AND ELECTROPHOTOGRAPHIC DEVELOPER CONTAINING THE SAME

(75) Inventors: Kanao Kayamoto, Kashiwa (JP); Issei Shinmura, Kashiwa (JP); Yuji Sato, Kashiwa (JP)

(73) Assignee: Powdertech Co., Ltd., Chiba (JP)

( * ) Notice: Subject to any disclaimer, the term of this patent is extended or adjusted under 35 U.S.C. 154(b) by 0 days.

(21) Appl. No.: 10/045,010

(22) Filed: Jan. 15, 2002

(65) Prior Publication Data

US 2002/0172884 A1 Nov. 21, 2002

(30) Foreign Application Priority Data

Mar. 30, 2001 (JP) ..... 2001-098440

(51) Int. Cl.[7] ..... G03G 9/10
(52) U.S. Cl. ..... 430/111.41; 430/111.33
(58) Field of Search ..... 430/111.41, 111.33, 430/111.32, 111.31, 111.35, 111.34, 111.1, 111.3

(56) References Cited

U.S. PATENT DOCUMENTS 5,512,402 A 4/1996 Okado et al. ..... 430/110.4
5,576,133 A 11/1996 Baba et al. ..... 430/122
5,595,850 A * 1/1997 Honjo et al. ..... 430/111.33
6,090,517 A * 7/2000 Tamura et al. ..... 430/111.33

FOREIGN PATENT DOCUMENTS

| | | |
|---|---|---|
| EP | 0 693 712 | 1/1996 |
| EP | 1 158 366 | 11/2001 |
| JP | B2 2769854 | 4/1998 |
| JP | A 10-198077 | 7/1998 |
| JP | B2 2832013 | 9/1998 |
| JP | B2 2854317 | 11/1998 |
| JP | B2 3029180 | 2/2000 |
| JP | A 2001-27828 | 1/2001 |

* cited by examiner

*Primary Examiner*—Janis L. Dote
(74) *Attorney, Agent, or Firm*—Young & Thompson

(57) ABSTRACT

A carrier for an electrophotographic developer comprising spherical magnetic core particles which have a volume average particle size of 25 to 45 $\mu$m, an average void size of 10 to 20 $\mu$m, a volume based particle size distribution having less than 1% of 22 $\mu$m or smaller particles, a magnetization of 67 to 88 emu/g in a magnetic field of 1 kOe, and a difference of 10 emu/g or smaller in magnetization in a magnetic field of 1 kOe between scattered particles and remaining particles.

4 Claims, No Drawings

CARRIER FOR ELECTROPHOTOGRAPHIC DEVELOPER AND ELECTROPHOTOGRAPHIC DEVELOPER CONTAINING THE SAME

FIELD OF THE INVENTION

The present invention relates to a carrier for an electrophotographic developer and an electrophotographic developer containing the same which get rid of the problem of carrier scattering and provide high image quality.

BACKGROUND OF THE INVENTION

Size reduction of carrier particles has been demanded for coping with the advanced technology of obtaining high image quality and the increasing trend to full color printing. With regard to full color printing, in particular, a toner concentration should be increased to carry out development over a wide area. Carrier size reduction results in an increased specific surface area and improved toner holding properties, which will make it possible to prevent toner scattering and thereby to produce high quality images free from fog for an extended period of time.

As the carrier size reduces, the magnetic brush formed becomes softer, making it possible to meet the image quality requirements, such as reproducibility of fine transverse lines (perpendicular to the paper transport direction) with no scratches and halftone uniformity.

Carrier size reduction is of necessity accompanied by the problem of carrier scattering. Carrier particles scattered on a photoreceptor cause an image defect called white spots and give scratches to the photoreceptor which also result in a image defect called white streaks. Hence, it has been difficult to obtain a high quality toner image without involving the problem of carrier scattering. A number of proposals have been made to date to accomplish these conflicting subjects.

For example, Japanese Patent 2,769,854 specifies a carrier having an average particle size of 20 to 60 $\mu$m in terms of percents passing a 250-mesh, a 350-mesh and a 400-mesh screen and a magnetization in a magnetic field of 3 kOe. As proposed, scattering of a carrier could be controlled by reducing the proportion of fine particles. However, to specify the magnetic characteristics of a carrier in a magnetic field of 3 kOe does not cope with the practical electrophotographic development system because the actual magnetic field for forming a magnetic brush on a sleeve is 1 kOe at the highest. From this viewpoint, the achievements in preventing carrier scattering while obtaining high image quality are unsatisfactory.

Japanese Patent 2,832,013 discloses a resin-coated carrier having a weighted average particle size of 30 to 65 $\mu$m, in which the carrier core has a specific average surface pore size. It seems that the patent specifies the surface porosity to represent the surface properties of carrier particles in terms of voids (gaps) among carrier particles and surface pores of the carrier particles. However, the voids among carrier particles are so small that a toner is not smoothly transferred to a photoreceptor and that the magnetic brush tends to be hard, failing to obtain satisfactorily high image quality such as reproducibility of fine lines. In addition, not grasping the particle size distribution and magnetic characteristics of the carrier which are important factors concerning carrier scattering, the patent fails to prevent carrier scattering satisfactorily.

Japanese Patent 2,854,317 specifies a carrier having a weighted average particle size of 20 to 60 $\mu$m in terms of percents passing a 250-mesh, a 350-mesh, a 400-mesh and a 500-mesh screen and magnetic characteristics in a magnetic field of 3 kOe, i.e., a magnetization, a residual magnetization, and a coercive force. Although the particle size distribution is specified, such a high magnetic field as 3 kOe is not actually obtained on a sleeve. Therefore, the countermeasure against carrier scattering cannot be seen as sufficient, still less consistent with image quality.

Japanese Patent 3,029,180 proposes a carrier having a median diameter ($D_{50}$) of 15 to 45 $\mu$m which is specified in terms of a particle size distribution (such as proportions of 22 $\mu$m or smaller particles and 16 $\mu$m or smaller particles), a specific surface area measured by an air permeation method, and an arithmetic surface area calculated from an average particle size and a specific gravity. To increase a specific surface area is effective to improve toner holding properties but insufficient against carrier scattering. Seeing that smooth toner movement through carrier particles is of importance for developability, the technique disclosed is insufficient for image quality.

JP-A-10-198077 discloses a carrier having a 50% diameter $D_{50}$ (volume basis) of 30 to 80 $\mu$m which has specific ratios of 10% diameter $D_{10}$, 50% diameter $D_{50}$ and 90% diameter $D_{90}$, contains not more than 3% of 20 $\mu$m or smaller particles, and has a magnetization of 52 to 65 emu/g in a magnetic field of 1 kOe. This is an attempt to prevent carrier scattering by specifying the particle size distribution and the magnetization in a magnetic field of 1 kOe. However, when a toner concentration varies, and the resistance of the developer reduces, carrier scattering occurs easily. Because of the low magnetization, the margin against carrier scattering cannot be seen as sufficiently broad.

JP-A-2001-27828 proposes a developer and an image forming apparatus which exhibit satisfactory toner transport and provide a high quality image. The carrier used therein has a weighted average particle size of 35 to 55 $\mu$m, a 22 $\mu$m or smaller particles content of 0 to 15%, and a 88 $\mu$m or greater particles content of 0 to 5% and is coated with a specific resin layer for fluidity improvement. The carrier preferably has a magnetization of 70 to 120 emu/g in a magnetic field of 1 kOe. While improvement of developer's fluidity is important, an excessive increase of magnetic characteristics leads to disadvantages arising from a hard magnetic brush, and the effects of soft development using small particles are impaired. In other words, although an increased magnetization is highly effective in preventing carrier scattering, a countermeasure against reduction of image quality due to a hardened magnetic brush is insufficient.

SUMMARY OF THE INVENTION

An object of the present invention is to provide a carrier for an electrophotographic developer and an electrophotographic developer containing the carrier which get rid of the problem of carrier scattering and provide high image quality.

As a result of extensive investigations, the present inventors have found that the above object is accomplished by a carrier the core of which is spherical magnetic particles having specific powder characteristics and magnetic characteristics.

The present invention provides a carrier for an electrophotographic developer comprising spherical magnetic core particles which have a volume average particle size of 25 to 45 $\mu$m, an average void size of 10 to 20 $\mu$m, a volume based particle size distribution having less than 1% of 22 $\mu$m or smaller particles, a magnetization of 67 to 88 emu/g in a magnetic field of 1 kOe, and a difference of 10 emu/g or smaller in magnetization in a magnetic field of 1 kOe between scattered particles and remaining particles.

The present invention also provides an electrophotographic developer comprising the carrier and a toner having an average particle size of 4 to 11 μm.

The present invention produces the following advantageous effects.

(1) The carrier, having a small-size core to form a soft magnetic brush, secures stable development to provide high quality images for an extended period of time.

(2) Having a given void size among particles, the carrier charges a toner with a sharp rise when a developer is replenished with a toner. As a result, toner scattering hardly occurs, and fog-free toner images are obtained. Further, the toner can be transported smoothly from a sleeve to a photoreceptor to form an image with improve halftone uniformity, fine transverse line reproducibility and the like.

(3) The increased magnetic characteristics of the carrier broadens the margin against carrier scattering. Further, the increased magnetic characteristics and a given void size maintain the magnetic brush soft to improve image quality while preventing carrier scattering.

(4) As long as the magnetization difference between scattered carrier particles and remaining carrier particles is small as specified, the margin against scattering of carrier particles having a sharp magnetization distribution is further broadened.

DETAILED DESCRIPTION OF THE PREFERRED EMBODIMENTS

The spherical magnetic carrier core of the present invention preferably contains manganese. Manganese ferrites can have their resistance controlled between the 6th to 10th power and their magnetization controlled between 67 and 90 emu/g in a magnetic field of 1 kOe by adjusting the composition and firing conditions and are therefore easy to make fit for various development systems. On the other hand, Cu—Zn ferrites, while having varied magnetizations according to the composition, are incapable of reaching such a high magnetization as specified in the present invention.

The carrier core particles have a volume average particle size of 25 to 45 μm. Within this range, the developer forms a dense and soft magnetic brush on a sleeve to exhibit improved developing performance in terms of fine transverse line reproducibility, halftone uniformity, and the like. If the volume average particle size is less than 25 μm, the carrier scatters easily, resulting in serious deterioration of image quality. If the volume average particle size is greater than 45 μm, carrier scattering is prevented, but it is difficult to maintain high image quality in terms of fine transverse line reproducibility and halftone uniformity.

The carrier core particles have an average void size (diameter) of 10 to 20 μm, preferably 12 to 18 μm. Within the range of 10 to 20 μm, the magnetic brush formed can be kept soft even with the increased magnetization of the carrier. Since voids of a given size are provided among individual carrier particles, toner particles are smoothly transported to a photoreceptor to form a high quality toner image. An average void size less than 10 μm results in a hard magnetic brush, failing to provide high image quality. If the average void size is greater than 20 μm, the number of contact points in particle chains of the magnetic brush is reduced to cause carrier scattering and, in addition, proportions of particles of a size increase, resulting in bad economy.

The volume based particle size distribution of the carrier core particles is such that the proportion of 22 μm or smaller particles is less than 1%, preferably 0.5% or less, to prevent carrier scattering. If the proportion of 22 μm or smaller particles is 1% or more, carrier scattering occurs easily, and such fine particles fill the gaps among carrier particles to make the magnetic brush hard, which results in reduction of image quality.

The carrier core particles have a magnetization of 67 to 88 emu/g in a magnetic field of 1 kOe to prevent carrier scattering effectively. A magnetization less than 67 emu/g easily causes the carrier to scatter. A magnetization more than 88 emu/g results in formation of a hard magnetic brush to reduce the image quality.

The difference in magnetization between scattered carrier core particles and remaining carrier core particles in a magnetic field of 1 kOe is up to 10 emu/g, preferably 5 emu/g or less. This small difference in magnetization secures a broadened margin against carrier scattering. If the difference exceeds 10 emu/g, carrier scattering occurs to reduce image quality considerably.

The volume average particle size, volume based particle size distribution, average gap size, magnetic characteristics, and magnetization difference between scattered particles and remaining particles are measured according to the following methods.

(1) Volume Average Particle Size and Its Distribution

Measurement was made with a particle size analyzer MICROTRAC 9320-X100, available from Nikkiso Co., Ltd.

(2) Average Gap Size

The average gap size was measure with a mercury porosimeter Model 220, supplied by Carlo Erba Instruments. The measurement theory of a mercury porosimeter is as follows. Solid repels liquid having a contact angle of 90° or more. Having a large surface tension, mercury shows a contact angle of 90° or greater (usually 115° to 145°) on almost all kinds of solid and therefore does not enter pores of a finely porous sample. Under an increasing pressure, mercury intrudes into the pores in a descending order of pore size.

While a mercury porosimeter is essentially used to measure the pores on the surface of solid in nature of the above-described theory, it is applicable to measurement of the size of the voids (gaps) formed among small-diameter particles of a given amount. The fine pores on the surface of individual particles are also measured but seem to make little contribution to the results because they are much smaller than the voids among the particles. It would be safe to regard the porosity as obtained with a mercury porosimeter as a voidage. The measurement was carried out under the following conditions.

Amount of sample: 500 mg

Mercury surface tension: 480.00 dyn/cm

Mercury contact angle: 141.30°

Capillary diameter: 3 mm (3) Magnetic Characteristics

Measurement was made with an integral type B-H loop tracer BHU-60, supplied by Riken Denshi Co., Ltd. An H coil for magnetic field measurement and a 4πI coil for magnetization measurement were placed between electromagnets. A sample was put into the 4πI coil. The electric current of the electromagnets was varied to vary the magnetic field H. The outputs of the H coil and the 4πI coil were integrated, respectively, and the H output were plotted on an X-axis and the 4πI coil output on a Y-axis to depict a hysteresis loop. Amount of sample: about 1 g; sample cell: 7 mm±0.02 mm in inner diameter, 10 mm in height; number of turns of 4πI coil: 30.

(4) Difference of Magnetization Between Scattered Particles and Remaining Particles Carrier particles were held on a sleeve having a magnet inside. The sleeve was revolved, and scattered carrier particles were collected. The magnetizations of the scattered particles and the particles remaining on the sleeve were measured with a vibrating sample magnetometer VSM-P7, supplied by Toei Kogyo K. K., in a magnetic field of 1 kOe, and the former was subtracted from the latter to obtain a difference.

The carrier of the present invention includes a resin-coated carrier obtained by forming a resin coat around the carrier core particles. Known materials are usable as a coating resin, such as silicone resins, various modified silicone resins, acrylic resins, styrene resins, fluorine resins, and combinations thereof. Combinations of a silicone resin, a modified silicone resin and a fluorine resin are preferred for durability. A straight silicone resin is still preferred. The resin coating weight is preferably 0.1 to 5%, still preferably 0.2 to 3%, by weight based on the core particles.

Where an insulated resin coat increases the carrier resistance, the resistance can be optimized by incorporating fine conductive particles such as carbon black, inorganic metals, inorganic oxides and inorganic nitrides into the resin.

Methods of coating the carrier core with a resin are not particularly limited. For example, a resin solution is applied to the carrier core by dipping, spraying, or a like coating technique, followed by evaporating the solvent. The coating layer can be baked, if desired, either by external heating or internal heating by means of, for example, a fixed bed or fluidized bed electric oven, a rotary kiln type electric oven, a burner oven, or a microwave oven. The baking temperature preferably ranges from 180 to 300° C. for silicone resins or from 100 to 180° C. for acrylic resins or styrene resins.

The carrier according to the present invention is mixed with a toner to provide a tow-component developer for electrophotography. The toner to be used comprises a binder resin having dispersed therein a colorant, a charge control agent, etc.

The binder resin which can be used in the toner includes, but is not limited to, polystyrene, chloropolystyrene, a styrene-chlorostyrene copolymer, a styrene-acrylic ester copolymer, a styrene-methacrylic acid copolymer, an epoxy resin, a polyester resin, and a polyurethane resin. These binder resins can be used either individually or as a mixture thereof.

The charge control agent which can be used in the toner is selected arbitrarily from known materials. Useful charge control agents include salicylic acid metal chelates, metallized monoazo dyes, and nigrosine dyes.

Any well-known dyes and pigments are useful as a colorant. Examples of suitable colorants for black are carbon black and black metal powders. Those for colors include Phthalocyanine Blue, Permanent Red, and Permanent Yellow. The colorant is used in an amount of about 0.5 to 10% by weight based on the binder resin.

One or more external additives, such as fine silica powder or titanium oxide powder which may be hydrophobilized, can be added to the toner particles.

The toner is prepared by, for example, dry blending a binder resin, a charge control agent and a colorant thoroughly in a mixing machine, e.g., a Henschel mixer, and the blend is melt-kneaded in, e.g., a twin-screw extruder. After cooling, the mixture is crushed in a feather mill, etc. and pulverized in a jet mill, etc., classified in an air classifier, etc. to obtain particles having a particle size of 4 to 11 μm, which are then mixed with necessary external additives in a mixing machine.

The toner may also be prepared by emulsion polymerization or suspension polymerization. These chemical methods are preferred from the standpoint of transfer efficiency because the resulting toner particles have a narrow size distribution.

The present invention will now be illustrated in greater detail with reference to Examples. Unless otherwise noted, all the percents are by weight.

EXAMPLE 1

Manganese ferrite particles having a volume average particle size of 35 μm, a 22 μm or smaller particles content of 0.5%, an average void size of 15.9 μm, a magnetization of 85 emu/g in a magnetic field of 1 kOe, and a magnetization difference of 3 emu/g between scattered particles and remaining particles (in a magnetic field of 1 kOe) as a carrier core were uniformly coated with a resin solution in a fluidized bed coating apparatus. The resin solution was prepared by mixing 2.0% (solid basis) of a silicone resin SR-2411, available from Dow Corning Toray Silicone Co., Ltd., based on the carrier core and 10% of γ-aminopropyltriethoxysilane based on the resin solid content and diluting the mixture with an organic solvent. The coating layer was baked at 250° C. for 3 hours, disintegrated, and screened through a 150-mesh sieve to remove coarse grains. The resulting carrier was designated carrier I.

Carrier I was blended with a magenta, a cyan, a yellow and a black toner for CF-70, available from Minolta Co., Ltd., to prepare a color developer having a toner concentration of 10%. The resulting four developers were loaded into a copier CF-70 from Minolta to carry out a copying test. The resulting color copies were evaluated in image density, fog, toner scattering, carrier scattering, fine transverse line reproducibility, halftone uniformity, and toner concentration stability according to the following methods and ranked on an A-to-E scale based on the following standards. Ranks A to C are levels acceptable for practical use. The results obtained are shown in Table 1.

Method and Standard for Evaluating Image Density:

The solid image density of copies produced under proper exposure conditions was measured with an X-Rite densitometer, supplied by Nippon Heihan Kizai K.K.

A . . . Very good

B . . . Within an aimed density range

C . . . Somewhat low but acceptable

D . . . Below the lower acceptable limit

E . . . Very low and impractical

Method and Standard for Evaluating Fog:

The fog density of copies produced under proper exposure conditions was measured with a color difference meter Z-300A, supplied by Nippon Denshoku Industries Co., Ltd.

A . . . Less than 0.5

B . . . 0.5 to 1.0

C . . . 1.0 to 1.5

D . . . 1.5 to 2.5

E . . . More than 2.5

Method and Standard for Evaluating Toner Scattering:

Toner scattering in the copier was observed with the naked eye.

A . . . No scattering

B . . . Little scattering

C . . . Critical but acceptable

D . . . Much scattering

E . . . Very much scattering

Method and Standard for Evaluating Carrier Scattering:

The number of white spots due to carry-over of carrier particles onto the photoreceptor was counted on ten copies of A3 size.

A . . . Nil

B . . . 1 to 5

C . . . 6 to 10

D . . . 11 to 20

E . . . 21 or more

Standard for Evaluating Fine Transverse Line Reproducibility:

A . . . Very good

B . . . Almost good

C . . . Critical but acceptable

D . . . Appreciable scratches

E . . . No reproduction

Standard for Evaluating Halftone Uniformity:

A . . . Very uniform

B . . . Uniform

C . . . Slightly uneven but acceptable

D . . . Appreciably uneven

E . . . Non-uniform with considerable unevenness

Standard for Evaluating Toner Concentration Stability:

A . . . Very stable

B . . . Stable

C . . . Slightly instable

D . . . Varied

E . . . Considerably varied

EXAMPLE 2

Manganese ferrite particles having a volume average particle size of 45 μm, a 22 μm or smaller particles content of 0.1%, an average void size of 14 μm, a magnetization of 67 emu/g in a magnetic field of 1 kOe, and a magnetization difference of 4 emu/g between scattered particles and remaining particles (in a magnetic field of 1 kOe) as a carrier core were coated with a resin solution containing 0.5% (solid basis) of an acryl-modified silicone resin KR-9706, available from Shin-Etsu Chemical Co., Ltd., based on the carrier core in an organic solvent in a fluidized bed coating apparatus. The coating layer was baked at 200° C. for 3 hours, disintegrated and classified in the same manner as in Example 1 to obtain carrier 2. Carrier 2 was tested in the same manner as in Example 1. The results obtained are shown in Table 1.

EXAMPLE 3

Manganese ferrite particles having a volume average particle size of 30 μm, a 22 μm or smaller particles content of 0.7%, an average void size of 15 μm, a magnetization of 88 emu/g in a magnetic field of 1 kOe, and a magnetization difference of 5 emu/g between scattered particles and remaining particles (in a magnetic field of 1 kOe) as a carrier core were uniformly coated with a resin solution in a fluidized bed coating apparatus. The resin solution was prepared by mixing 2.5% (solid basis) of the same silicone resin as used in Example 1 based on the carrier core and 16% of γ-aminopropyltriethoxysilane based on the solid resin content and diluting the mixture with an organic solvent. The coating layer was baked at 270° C. for 3 hours, disintegrated and classified in the same manner as in Example 1 to obtain carrier 3. Carrier 3 was tested in the same manner as in Example 1. The results obtained are shown in Table 1.

EXAMPLE 4

Carrier 4 was prepared in the same manner as in Example 1, except for using as a carrier core manganese ferrite particles having a volume average particle size of 25 μm, a 22 μm or smaller particles content of 0.9%, an average void size of 11 μm, a magnetization of 70 emu/g in a magnetic field of 1 kOe, and a magnetization difference of 4 emu/g between scattered particles and remaining particles (in a magnetic field of 1 kOe). Carrier 4 was tested in the same manner as in Example 1. The results obtained are shown in Table 1.

EXAMPLE 5

Carrier 5 was prepared in the same manner as in Example 1, except for using as a carrier core manganese ferrite particles having a volume average particle size of 30 μm, a 22 μm or smaller particles content of 0.8%, an average void size of 14.5 μm, a magnetization of 70 emu/g in a magnetic field of 1 kOe, and a magnetization difference of 9 emu/g between scattered particles and remaining particles (in a magnetic field of 1 kOe). Carrier 5 was tested in the same manner as in Example 1. The results obtained are shown in Table 1.

COMPARATIVE EXAMPLE 1

Carrier 6 was prepared in the same manner as in Example 1, except for using as a carrier core manganese ferrite particles having a volume average particle size of 50 μm, a 22 μm or smaller particles content of 0.3%, an average void size of 4 μm, a magnetization of 70 emu/g in a magnetic field of 1 kOe, and a magnetization difference of 4 emu/g between scattered particles and remaining particles (in a magnetic field of 1 kOe). Carrier 6 was tested in the same manner as in Example 1. The results obtained are shown in Table 1.

COMPARATIVE EXAMPLE 2

Cu—Zn ferrite particles having a volume average particle size of 35 μm, a 22 μm or smaller particles content of 0.7%, an average void size of 16 μm, a magnetization of 60 emu/g in a magnetic field of 1 kOe, and a magnetization difference of 5 emu/g between scattered particles and remaining particles (in a magnetic field of 1 kOe) as a carrier core were uniformly coated with a resin solution in a fluidized bed coating apparatus. The resin solution was prepared by dissolving 3.0% (solid basis) of the same silicone resin as used in Example 1 based on the carrier core and 18% of γ-aminopropyltriethoxysilane based on the solid resin content in an organic solvent. The coating layer was baked at 285° C. for 3 hours, disintegrated and classified in the same manner as in Example 1 to obtain carrier 7. Carrier 7 was tested in the same manner as in Example 1. The results obtained are shown in Table 1.

COMPARATIVE EXAMPLE 3

Carrier 8 was prepared in the same manner as in Example 2, except for using as a carrier core manganese ferrite particles having a volume average particle size of 30 μm, a 22 μm or smaller particles content of 4.8%, an average void size of 7 μm, a magnetization of 85 emu/g in a magnetic field of 1 kOe, and a magnetization difference of 4 emu/g between scattered particles and remaining particles (in a magnetic field of 1 kOe). Carrier 8 was tested in the same manner as in Example 1. The results obtained are shown in Table 1.

COMPARATIVE EXAMPLE 4

Carrier 9 was prepared in the same manner as in Example 1, except for using as a carrier core manganese ferrite particles having a volume average particle size of 35 μm, a 22 μm or smaller particles content of 0.4%, an average void size of 15 μm, a magnetization of 70 emu/g in a magnetic field of 1 kOe, and a magnetization difference of 13 emu/g between scattered particles and remaining particles (in a magnetic field of 1 kOe). Carrier 9 was tested in the same manner as in Example 1. The results obtained are shown in Table 1.

TABLE 1

| | Example No. | | | | | Comparative Example No. | | | |
|---|---|---|---|---|---|---|---|---|---|
| | 1 | 2 | 3 | 4 | 5 | 1 | 2 | 3 | 4 |
| Initial Stage (image area ratio: 10%) | | | | | | | | | |
| Image density | A | A | A | A | A | A | B | A | A |
| Fog | A | B | A | A | A | C | C | B | A |
| Toner scattering | A | B | A | B | B | C | B | B | B |
| Carrier scattering | A | A | B | C | C | A | E | E | E |
| Fine transverse line reproducibility | A | B | B | B | C | E | E | E | E |
| Halftone uniformity | A | B | B | B | C | E | E | E | E |
| After obtaining 50,000 copies (image area ratio: 20%) | | | | | | | | | |
| Image density | A | A | A | A | A | B | B | A | A |
| Fog | A | B | A | A | A | C | C | B | A |
| Toner scattering | A | B | A | A | B | D | B | B | B |
| Carrier scattering | A | A | B | C | C | A | E | E | E |
| Fine transverse line reproducibility | A | B | B | B | C | E | E | E | D |
| Halftone uniformity | A | B | B | B | C | E | E | E | E |
| Toner concentration stability | A | A | B | C | A | C | A | D | A |
| After obtaining 100,000 copies (image area ratio: 10%) | | | | | | | | | |
| Image density | A | A | A | A | A | B | B | A | A |
| Fog | A | B | A | A | A | C | C | B | A |

TABLE 1-continued

| | Example No. | | | | | Comparative Example No. | | | |
|---|---|---|---|---|---|---|---|---|---|
| | 1 | 2 | 3 | 4 | 5 | 1 | 2 | 3 | 4 |
| Toner scattering | A | B | A | C | A | D | B | B | B |
| Carrier scattering | A | A | B | C | C | A | E | D | E |
| Fine transverse line reproducibility | A | B | B | B | C | E | E | D | D |
| Halftone uniformity | A | B | B | B | C | E | E | D | D |
| Toner concentration stability | A | A | B | C | A | C | B | D | A |

What is claimed is:

1. A carrier for an electrophotographic developer comprising spherical magnetic core particles which have a volume average particle size of 25 to 45 μm, an average void size of 10 to 20 μm, a volume based particle size distribution having less than 1% of 22 μm or smaller particles, a magnetization of 67 to 88 emu/g in a magnetic field of 1 kOe, and a difference of 10 emu/g or smaller in magnetization in a magnetic field of 1 kOe between scattered particles and remaining particles.

2. The carrier for an electrophotographic developer according to claim 1, wherein said core particles have a resin coat, the average void size of said core particles is 12 to 18 μm, and the difference in magnetization in a magnetic field of 1 kOe between scattered particles and remaining particles is 5 emu/g or smaller.

3. An electrophotographic developer comprising the carrier according to claim 1 and a toner having an average particle size of 4 to 11 μm.

4. An electrophotographic developer comprising the carrier according to claim 2 and a toner having an average particle size of 4 to 11 μm.

* * * * *